US007058471B2

(12) United States Patent
Watanabe

(10) Patent No.: US 7,058,471 B2
(45) Date of Patent: Jun. 6, 2006

(54) SYSTEM AND METHOD FOR CUSTOM-MADE CLOTHING

(76) Inventor: John S. Watanabe, 24 Dong Wang Zhuang 3d Door, Apt. 302, Beijing (CN) 100083

( * ) Notice: Subject to any disclaimer, the term of this patent is extended or adjusted under 35 U.S.C. 154(b) by 21 days.

(21) Appl. No.: 10/342,671

(22) Filed: Jan. 14, 2003

(65) Prior Publication Data

US 2004/0158345 A1 Aug. 12, 2004

(51) Int. Cl.
*G06F 19/00* (2006.01)

(52) U.S. Cl. ..... 700/132; 112/475.09

(58) Field of Classification Search ..... 700/130–134; 112/475.09

See application file for complete search history.

(56) References Cited

U.S. PATENT DOCUMENTS

| | | | | | |
|---|---|---|---|---|---|
| 2,762,124 | A | | 9/1956 | D'Angelo | 33/16 |
| 4,136,452 | A | * | 1/1979 | McMillan | 33/17 R |
| 4,807,143 | A | | 2/1989 | Matsuura | 364/468 |
| 4,860,900 | A | * | 8/1989 | Forschner | 206/574 |
| 5,330,652 | A | | 7/1994 | Croyle et al. | 700/130 |
| 5,508,936 | A | * | 4/1996 | King et al. | 700/135 |
| 5,548,519 | A | | 8/1996 | Park et al. | 700/135 |
| 5,680,314 | A | | 10/1997 | Patterson | 364/470.03 |
| 5,768,135 | A | | 6/1998 | Park | 364/470.01 |
| 5,825,652 | A | * | 10/1998 | LeBlond et al. | 700/132 |
| 5,956,525 | A | * | 9/1999 | Minsky | 396/3 |
| 6,353,770 | B1 | | 3/2002 | Ramsey et al. | 700/131 |
| 6,415,199 | B1 | * | 7/2002 | Liebermann | 700/132 |
| 6,499,513 | B1 | * | 12/2002 | Couch | 112/470.03 |

OTHER PUBLICATIONS

Stephenson, "Seeds: creative strategies inspired by nature," © W. David Stephenson 1989-1999, http://www.stephensonstrategies.com.

* cited by examiner

*Primary Examiner*—John J. Calvert
*Assistant Examiner*—Brian Kauffman
(74) *Attorney, Agent, or Firm*—Pillsbury Winthrop et al.

(57) ABSTRACT

A garment facility produces custom-made garments according to the body contour and the fit preferences of a customer. Try-on garments for various styles of garments are presented to customers for selection. The tailor will retrieve the one or more base patterns associated with the try-on garment. The pieces of the base patterns are marked and modified according to both the body contour and the fit preferences of a customer and connected as sample garment for try-on. The marked pieces are recorded and sent to a cutting machine as digital data. Multiple try-on garments can be combined to form new sample garments. A favorite garment of the customer can be recorded as digital data to re-produce the custom-made garments.

60 Claims, 14 Drawing Sheets custom-made garment facility 100

FIGURE 2 – Try-on Garment (200)
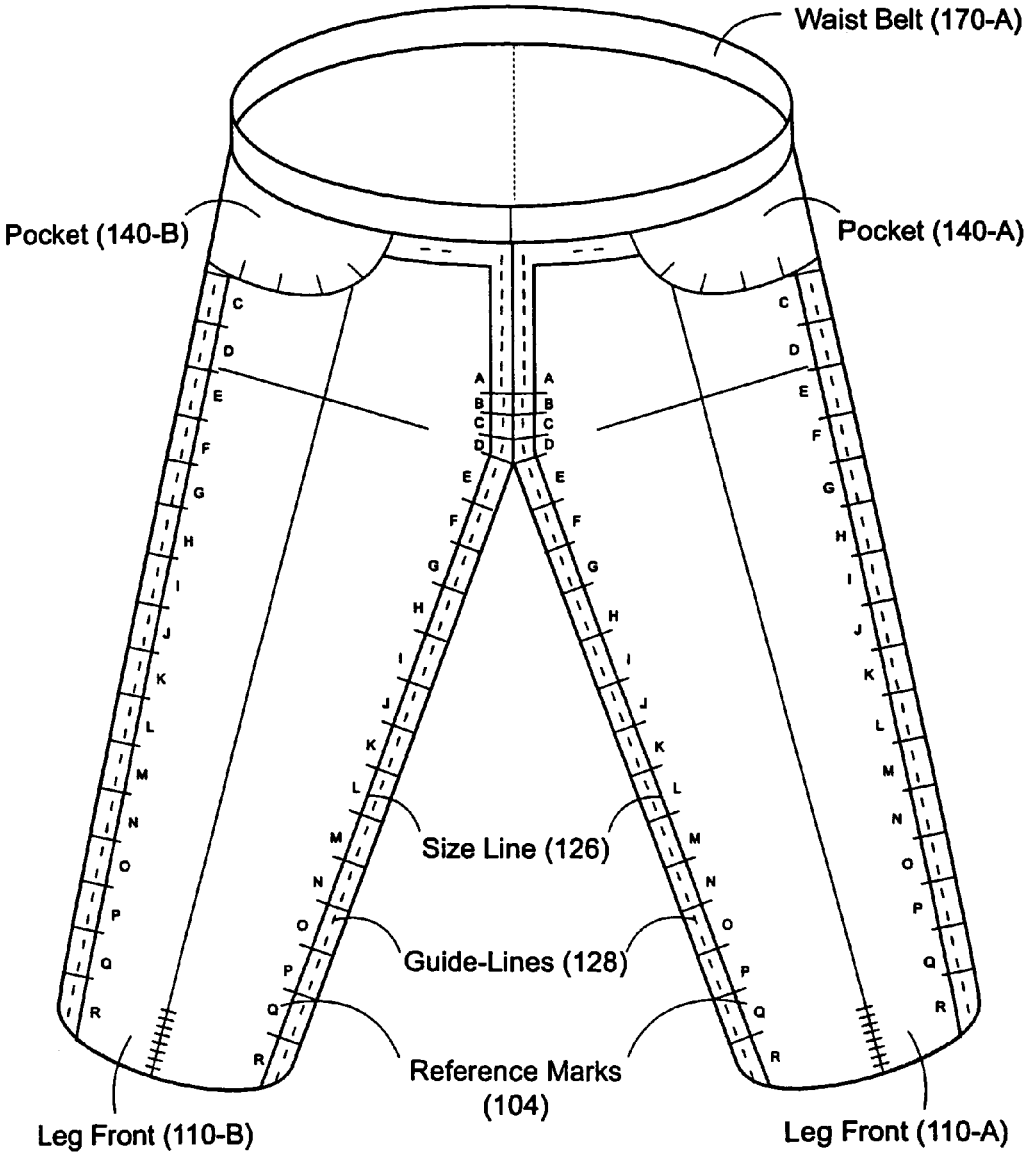

FIGURE 3 -- Base Pattern (210)
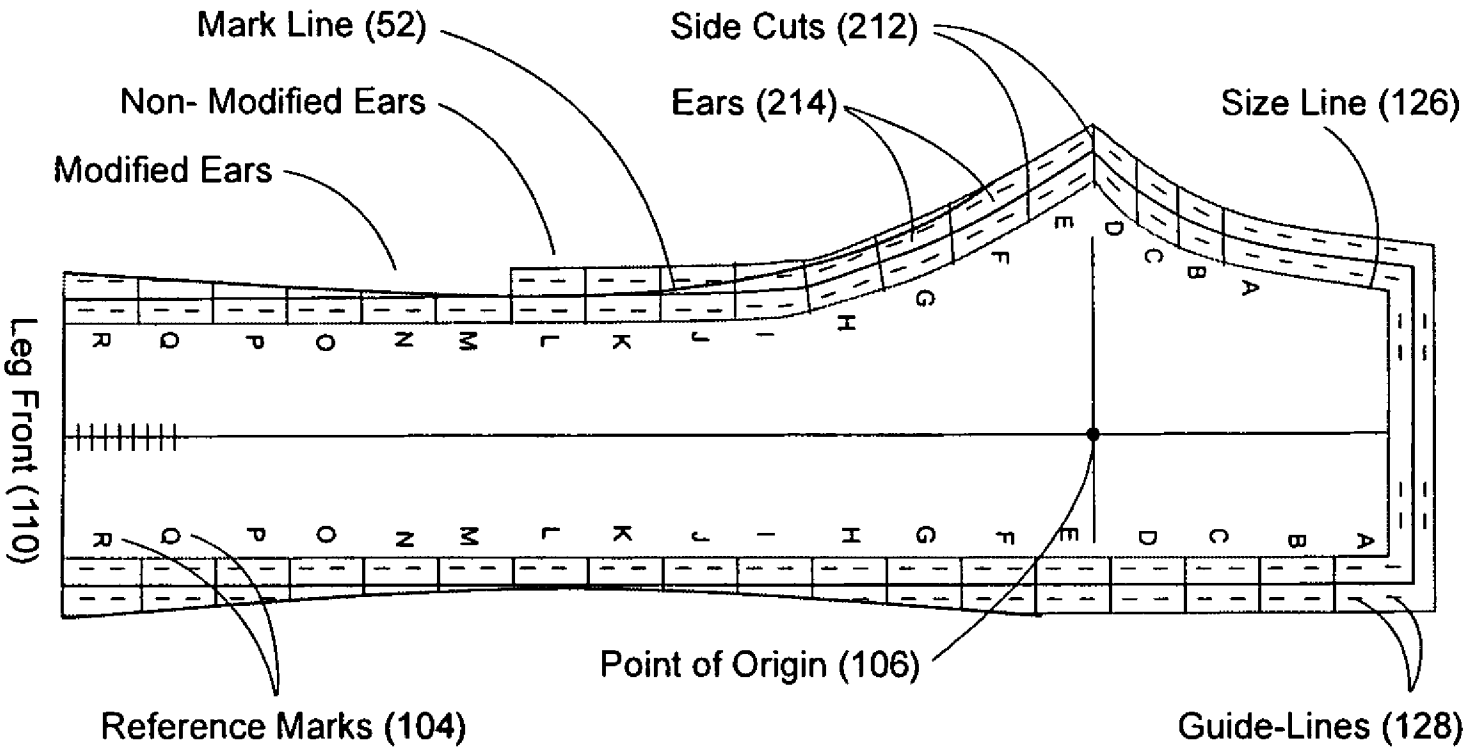

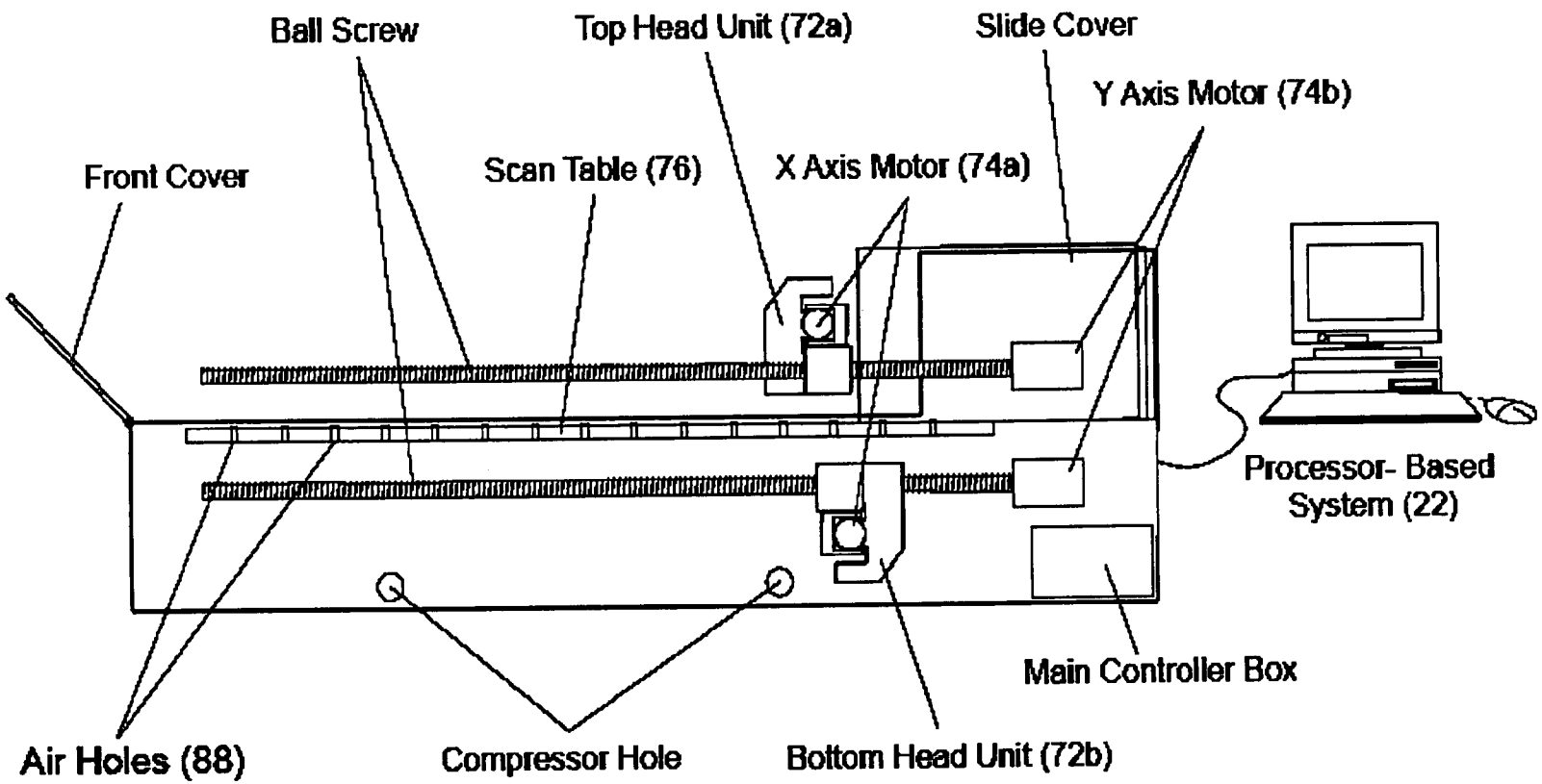
Figure 4A – Scanner System (10)

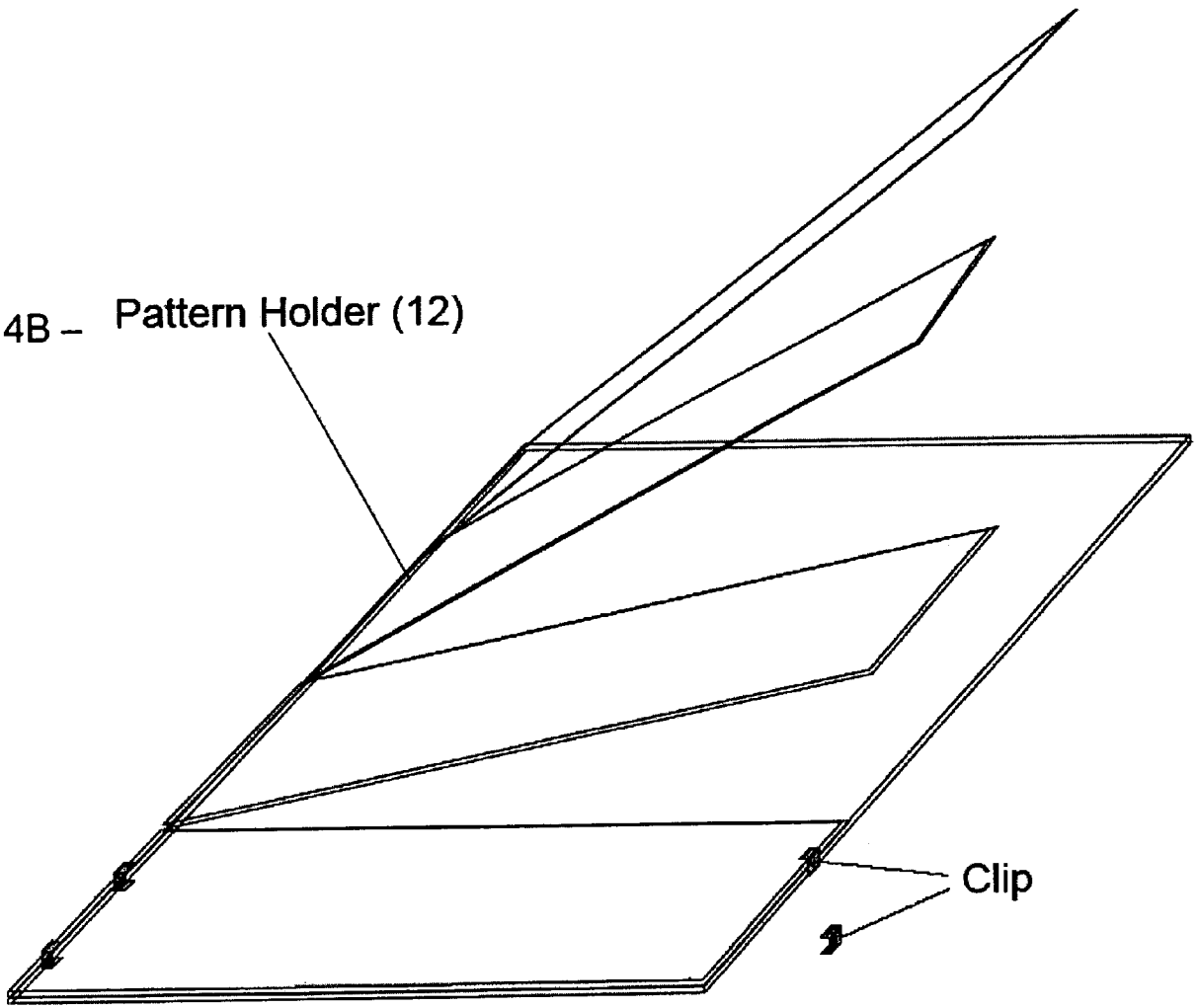
Figure 4B –

FIGURE 5 -- Base Patterns (210)
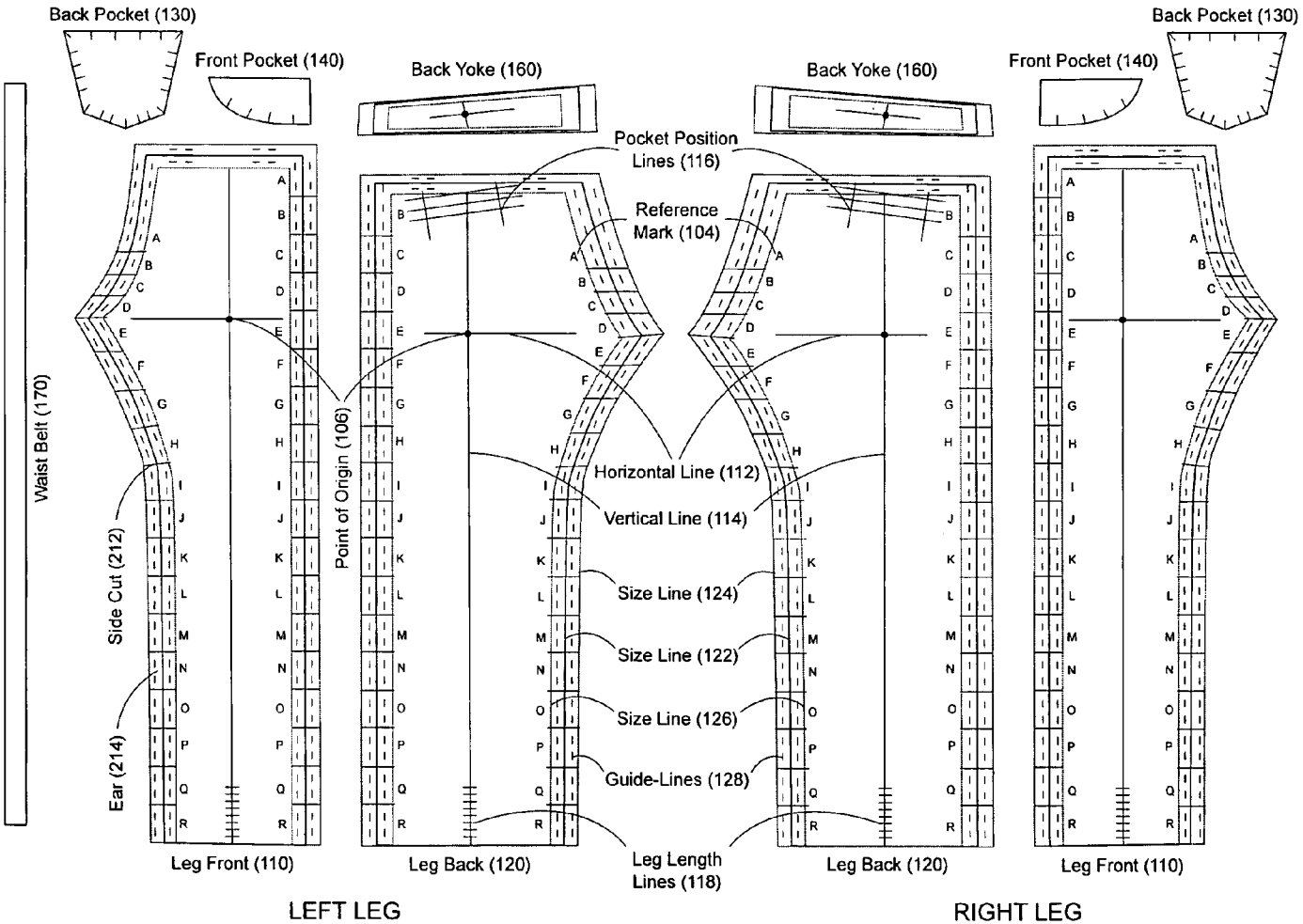

SYSTEM AND METHOD FOR CUSTOM-MADE CLOTHING

FIELD OF THE INVENTION

This invention relates to the manufacture of clothing and, more particularly, to a system and method for providing custom-made clothing for customers based on fit and style preferences, for example.

BACKGROUND OF THE RELATED ART

One of the ways the clothing industry seeks to be profitable is by mass-producing garments in only a few sizes. T-shirts, for example, usually are available in small, medium, and large sizes. One-size-fits-all is a familiar sizing option for some garments as well.

Even where ten or more garment sizes are offered for sale, many customers seem not to fit into any of the available sizes. Consider, for example, a customer with a large waist and thin legs. Since the waist size is large, the customer is more likely to regularly find pants that are too loose on the legs or too tight in the waist. Also, the customer may find pants that will fit, but may not prefer the pants design.

Some changes are evident in the clothing industry. Some garment stores, for example, offer pants in many different styles, hoping to fit a larger percentage of customers. Still, the almost infinite variety of body sizes and fit preferences frustrate the ability to satisfy all customers.

Some garment manufacturers offer custom-fitting facilities, in which a customer either visits a sizing location or submits size data to the facility. For on-site service, a variety of sizing methods can be employed, from computer-directed body scanning techniques to the use of a tape measure. Once the body contour of the customer is established, a customer-specific garment can be produced.

Often, these facilities fail to produce customer satisfaction, since body contour measurements alone are used to produce the garment. Such measurements fail to account for the fit or design preferences of the customer.

Alternatively, garment manufacturers may request that customers make intermediate visits to the facilities so that they may try on a temporarily stitched garment, based upon the measurements taken. After trying on the temporary garment, the customer can opt for minor changes in the final stitching to make the garment fit or to adhere to a design as desired. However, since the material has already been cut in accordance with the preliminary measurements, adjustments in the fit and design will be limited to the amount of material that remains. Furthermore, manufacturers employing this methodology for supplying custom-made garments require the customer to make at least two separate visits to the sizing facility. Time-conscious customers would certainly prefer a system that requires as few visits as possible.

Another method adopted by some manufacturers is to use sizing garments to better ascertain the customer's preferences regarding fit. For example, U.S. Pat. No. 5,680,314 describes a partially finished sizing garment, with open extended overlapping seams. Upon wearing the garment, the customer specifies a fit preference, after which the garment size is recorded.

The partially finished portion of the sizing garment, however, limits the available fit that can be achieved for the customer. Only the unfinished portion is flexible enough to permit adaptation to the body contour of the customer or to be adjusted according to the customer's preferences. Thus, if the partially finished portion of the garment does not fit the customer properly or does not meet with the customer's style preference, the custom fitting will not succeed.

When designing the garments, adjusting an unfinished portion will not look right if the contour of the adjustment doesn't correspond to the partially finished portion. Generally, if the unfinished portion is to be modified, the finished portion will likewise need to be modified, to ensure that the garment has the proper drape and shape.

For example, the unfinished portion of a pants garment cannot be adjusted to have flare in the leg if the finished portion of the pants has already been cut to have a straight leg design. If the unfinished portion is to be modified and does not correspond to the finished portion, an improper drape of the garment is likely, resulting in unsuccessful design and sizing of the garment.

Finally, the partially finished sizing garment is sized by recording the desired fit, with each measurement point corresponding to an indicator affixed to the sizing garment. The indicator may include lines, color markings, numerals, or a combination thereof. If the facility employee incorrectly records the size preference, there is no way to inspect the final product for accuracy.

Furthermore, when a curved line is marked on the sizing garment during fitting, such as to indicate flared legs in pants, the curve may not be recorded, due to a limited number of measurement points. Increasing the number of measurement points improves the situation, but also increases the possibility that an entry is incorrectly recorded.

Thus, there is a continuing need to provide a way for true custom fitting of garments to be made.

SUMMARY OF THE INVENTION

According to the embodiments described herein, a method is disclosed in which a try-on garment is created from a plurality of base patterns, the base patterns are retrieved and marked according to the body shape and fit and/or style preferences of a customer, then modified and connected to create a sample garment based on the marks, and the marked sample garment is scanned to generate customer data. The method further comprises cutting material for a custom-made garment based on the customer data and sewing the cut material together to form the custom-made garment.

Further, a system for producing custom-made garments is disclosed comprising a plurality of try-on garments, wherein each try-on garment associate with one or more pieces of base patterns to be modified and connected together to create a sample garment for sizing on a customer; and a recording system comprising at least one imaging device and the one or more pieces of the sample garment are recorded by the imaging device as digitized data. In some embodiments, the system further comprises a cutting machine, which cuts fabric based upon the digitized data. The system may further comprise a pattern holder for maintaining the positions of the one or more pieces of the sample garment during the recording operation.

Advantages and other features of the invention will become apparent from the following description, the drawings, and the claims.

BRIEF DESCRIPTION OF THE DRAWINGS

FIG. 2 is a diagram of a try-on garment for a pair of pants in accordance with a preferred embodiment of the present invention to be used in one example of the custom-made garment facility of FIG. 1;

FIG. 3 is a diagram illustrating how a base pattern is modified in accordance with a preferred embodiment of the present invention;

FIG. 4A is a side-view diagram of a scanner in accordance with a preferred embodiment of the present invention to be used in one example of the custom-made garment facility of FIG. 1;

FIG. 4B is a perspective drawing of a pattern holder in accordance with a preferred embodiment of the present invention to be used in one example of the custom-made garment facility of FIG. 1;

FIG. 5 is a diagram of base patterns for a pair of pants in accordance with a preferred embodiment of the present invention to be used in one example of the custom-made garment facility of FIG. 1;

DETAILED DESCRIPTION

Generally, in accordance with the embodiments described herein, a garment facility produces custom-made garments according to both the body contour, fit and style preferences of a customer. Sample garments, made by connecting one or more base patterns together, are made available to the customer for fitting.

Each sample garment is made from base patterns that have been marked and modified by tailors or other persons associated with the facility, according to the desired fit and the body contour of the customer. The marked sample garment is then scanned and information corresponding to the marks and desired modifications are sent to a cutting machine as digital data. Material for the custom-fit garment is then cut according to the digital design data and the cut items are sewn together to form the custom-made garment. Various sample garments created from different base patterns can be the basis for other custom-made garments.

Figure 1:
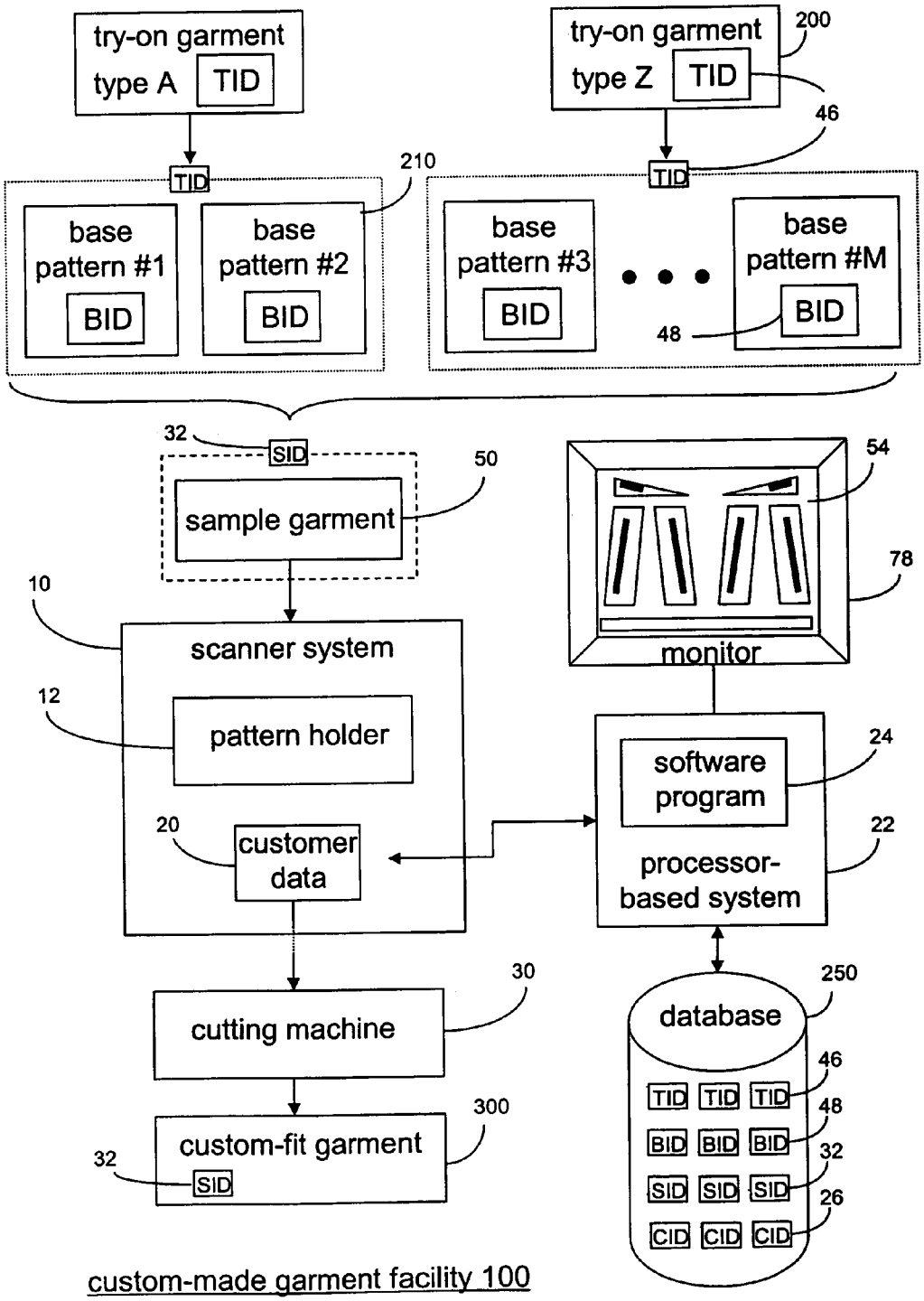
FIG. 1 is a schematic diagram of a custom-made garment facility according to one embodiment of the invention.

In FIG. 1, one example of a custom-made garment facility 100 according to the invention is depicted for producing custom-made garments. The custom-made garment facility 100 includes multiple try-on garments 200, each associated with a set of one or more design-adjustable base patterns 210. A sample garment 50, produced from pieces of one or multiple base patterns 210 (typically associated and retrieved from one try-on garment 200 but possibly several), is scanned by a scanner system 10, and the scanned image of sample garment 50 is digitized for storage and subsequent retrieval as customer data 20. This data may be immediately provided to a cutting machine 30, to produce a custom-fit garment 300 according to the customer's body contour and fit preferences or retrieved at a later time for cutting. Preferably, cutting machine 30 is housed in the same location as scanner system 10, but may alternatively be placed at a remote location.

As referred to herein, a base pattern 210 is an individual pattern piece comprising the try-on garment 200, such as a left leg front, a back yoke, and so on. For example, a base pattern 210 for the try-on garment 200 illustrated in FIG. 2 (e.g. a pair of pants) may be a front left leg piece 110-A, a front right leg piece 110-B, a back left leg piece (not shown), a back right leg piece (not shown), a left back yoke piece (not shown), a right back yoke piece (not shown), a waistband piece 170-A, front pocket pieces 140-A and 140-B, and back pocket pieces (not shown).

In one embodiment, the try-on garment 200 can be further categorized according to garment type, such as those for pants, skirts, dresses, and the like. For each try-on garment type, a number of base patterns, each possibly associated with a different style, can be available for creating the sample garment 50. For example, a "pants" garment type can have different styles such as pants with flare legs, straight legs, low riders, bell-bottoms, hip-huggers, reverse fit, Capri-length, and other styles, in one embodiment. It should be thus apparent that, although FIG. 1 illustrates only one try-on garment 200 of type A (e.g. a skirt), that there may be many styles (e.g. mini-skirt, long skirt, tight skirt, etc.) of garment type A available to a customer, each having a separate associated try-on garment 200.

A unique try-on garment identifier (TID) 46 is associated with each try-on garment 200 and a unique base pattern identifier (BID) 48 is associated with each base pattern 210, in one embodiment. The TID and BID are printed on or attached to the try-on garment 200 and base pattern 210 where they will be visible. Each TID 46 and BID 48 is preferably stored in a database 250, accessible to the custom-made garment facility 100. As used herein, database 250 refers to a storage device such as a hard disk drive, an optical disk drive such as CD-ROM or DVD-ROM, tape media drive, or other storage device, whether or not structured as a database with associated database software (e.g. Oracle or Microsoft Access).

Preferably, in database 250 and/or using associated software, TID 46 and BID 48 are relationally linked, and each TID is used to identify and retrieve one or more BIDs constructing the try-on garment 200 automatically. Accordingly, the facility tailor or other person can retrieve associated base patterns 210 comprising the try-on garment, or the try-on garments themselves, using the linked identifiers at the custom-made garment facility 100. For example, as shown in FIG. 1, a first BID (BID1) is linked to a first base pattern, a second BID (BID2) is linked to a second base pattern, a third BID (BID3) is linked to a third base pattern, and so on. A try-on garment identifier (TID), which identifies a combination of base patterns for one style of garment type A, is relationally linked to BID1 and BID2. The custom-made garment facility 100 can store thousands of try-on garments 200 and base patterns 210, in one embodiment.

According to another aspect of the invention, each base pattern 210 can be a design-adjustable pattern piece. In the example shown in FIG. 3, base pattern 210 has a plurality of side cuts 212 cut into the outer periphery of at least part of the fabric and creating one or more ears 214. The ears are flexible so that by folding each ear, the base pattern's design can be modified. For example, the bottom left ears have been modified to define a flare in the bottom pant leg in FIG. 3. Depending on the garment's texture and design, the side cuts' length, shape, number and position can differ.

In one embodiment, based on the preferred try-on garment 200 selected by a customer, one or more associated base patterns 210 are also retrieved (e.g. from the illustrated style of try-on garment type A, base patterns #1 and #2 are selected in FIG. 1). A customer service representative, such as an on-site tailor, then marks up the base patterns according to the desired fit, style and/or the body contour of the customer. Each piece of the base pattern is marked (e.g. with some kind of medium that will stay on the base pattern for a limited period of time—examples include a naturally disappearing type of CHAKO Pen (available from Adger Kogyo Co., Ltd. of Japan), whose marks will naturally disappear in a few days or immediately disappear by using an iron and adding heat to the drawn line, see http://www.squaresmachinery.com/adger.htm, and chalk) with a "mark line 52." The mark line 52 identifies any modification to be made to the piece, for example, how the piece is to be connected to an adjacent piece according to the desired fit of the customer, in a manner similar to custom-tailoring.

During the marking process of the base pattern, care must be taken so that the mark lines 52 are marked on the ears 214 where the base pattern will be modifiable. In addition, the try-on garment 200 and the associated base pattern 210 have reference marks 104 in the same location as to help the tailor locate adjustment points on the base pattern from the try-on garment. For example, as a person (e.g. customer) is trying on a try-on garment 200, a tailor has at his/her disposal, the complete set of loose base patterns associated with that try-on garment. So the tailor can use the reference marks 104 on the try-on garment 200 worn by the customer to locate and identify adjustment points on the loose base patterns in accordance with the person's fit and preferences, without needing to use a tape measure or other methods that are possibly uncomfortable for the customer.

By modifying and connecting the pieces of the one or more base patterns 210 based on the mark lines 52, the tailor produces the sample garment 50. The base pattern pieces are connected together before the sample garment is tried on, such as with thread, snaps, tape, VELCRO (trademark of 3M Corp.) or other connection means. In one embodiment, base patterns are connected together using thread and a sewing method called a "chain stitch". A "chain stitch" can be made using a factory-type sewing machine, such as those widely used in most garment factories. The chain stitch has one unique point wherein if one thread becomes loose and that thread is pulled, all the thread will come off. Other preferred methods to securely connect and then easily separate the modified base patterns should be apparent to those skilled in the art, such as by using staples. Also, tape or Velcro VELCRO (trademark of 3M Corp.) can be used to position the back pockets.

Depending on the garment's design, the sample garment 50 can be made from a single base pattern 210, or from multiple base patterns 210. Also, since each base pattern is a design-adjustable piece, the same base pattern piece can be modified in different ways to create different styles of sample garments. Moreover, base patterns retrieved from different styles of try-on garments 200 can be modified and selectively connected with one another to create a completely new sample garment. For example, the front legs of the sample garment can come from a first try-on garment-associated base pattern while the back legs of the sample garment come from a second try-on garment-associated base pattern. The custom-made garment facility 100 allows the customer to identify desired features of each possible garment style and use those features interchangeably in producing a sample garment 50 for trying on. For example, a customer can select a try-on garment 200, from which one or more base patterns 210 are retrieved, and the customer can also discuss with the person associated with garment facility 100 how the customer wants to modify them to obtain desired features.

Furthermore, the customer can select two or more different styles of try-on garments 200 and combine their designs to create a new design, which is another embodiment of the invention that will be described in more detail below.

During a customer order process (including the selection of a try-on garment 200, and the mark-up of its associated base patterns 210 as set forth above), a unique sample garment identifier (SID) 32 is assigned to the final sample garment 50, in one embodiment. As with the unique try-on garment identifier (TID) 46 and the unique base pattern identifiers (BID) 48, each SID 32 is stored in the database 250. In one embodiment, when the custom-made garment 300 is ultimately produced, its associated SID 32 will be printed on or attached to the garment. At a later time, the SID 32 can thus be readily obtained and used to retrieve the sample garment data so as to reproduce the sample garment for a new custom fitting, or for reorder of the custom-made garment 300.

Furthermore, the composition of the sample garment 50 is maintained in the database 250. Thus, for example, a sample garment 50 comprising base pattern #1 and base pattern #2, will be so recorded in the database 250. Later, the sample garment can be modified, such as by replacing one of the base pattern pieces with another piece from a different style of try-on garment 200. A great variety of fitting options is thus available in the custom-made garment facility 100.

In addition, each customer will be assigned a unique customer identifier (CID) 26, when ordering a first custom-made garment from sample garment 50 for example. The CID 26 is linked to customer information such as billing address, shipping address, customer dimensions, customer order history of custom-made garments (SIDs) and so on, which customer information is maintained in the database 250. Furthermore, in one embodiment, the database is network-accessible, such that the database is available to employees of the custom-made garment facility who may operate in remote locations worldwide. Also, a customer will be able to send the SID printed on or attached to the custom-made garment 300 via a data communications network such as the Internet to the garment facility to re-order the custom-made garment. Security measures, well known to those in the industry, can be provided to limit access to the CID and other information in the database 250 to only those so authorized.

Ideally, try-on garment identifiers (TIDs), base pattern identifiers (BIDs), sample garment identifiers (SIDs), and customer identifiers (CIDs) are relationally linked in the database. The CID for a customer can be linked to the BIDs and SIDs agreed upon during the fitting operation, but individual customer information assigned to each CID contained in the database 250 would not be readily accessible by others. However, the association of a CID with a particular BID or SID does not preclude the BID or SID from being used by another customer. In other words, once a base pattern/sample garment arrangement is stored in the database, it may potentially be used by customers other than the original customer.

Once the various marked-up and modified base pattern pieces are connected and fitted on the customer, and the customer agrees with the fit and design, the sample garment 50 is disassembled and scanned by scanner system 10. As will be described in more detail below, the scanner system is used to identify the mark lines 52 on each piece and, accordingly, produce digital data, shown as customer data 20, including digital data that represents the mark lines 52 that determine how the pieces were modified and connected to form the sample garment.

Referring back to FIG. 1, a computer system 22 is connected to the scanner system 10, in one embodiment. The computer system 22 can be a personal computer or other processor-based system, such as a desktop, a laptop or tablet PC, for executing software instructions. The computer system can include an input device (not shown), such as a keyboard, a mouse, or a touch panel pen, with which the tailor can adjust the mark lines before the customer data 20 is generated. The computer system can further includes a video panel or monitor 78 to display the scanned images of the various patterns comprising customer-marked sample garment 50. Although depicted as a contiguous entity, the custom-made garment facility 100 can be physically distributed as two or more separate facilities. Accordingly, for example, the customer data 20 produced by a scanner system 10 at one site can be sent to a remote site where cutting machines 30 are operated, such as in a factory environment. Further, the computer system 22 can be distributed among different sites. Moreover, some or all of the scanner system 10 and computer system 22 (e.g. a processor for executing one or more of the programs 24) can be combined in one unit.

The computer system 22 preferably includes one or more software programs 24 which control the operation of the scanner, and retrieve the image output therefrom in order to identify the mark lines 52 The scanner's operation can be controlled in basically the same manner as typical document scanners commonly used with computer systems today (except that the scanner of the present invention can include top and bottom scan cameras and a top head ink jet printer as will be described in more detail below). Accordingly, programs 24 can include interface and control programs, adapted from or known to those of skill in the art, to control the scanner system 10 and to send appropriate commands to the scanner system 10. In one example operation of program 24, first it will cause the scanner system 10 to make a rough scan of the entire scan table 76 and to display the whole scanned image on the monitor 78. Next, a tailor can specify the area that needs to be scanned in more detail (e.g. the area including only one of the pattern pieces when multiple pattern pieces are placed on the table 76) and the program 24 will cause scanner system 10 to start the detail scan operation. The detail scan output image data can then be converted to a proprietary or standard format such as JPEG, TIFF or DXF (DXF is a format widely used in the CAD industry), preferably one that is able to handle color images.

According to one aspect of the invention, the reference marks, guide lines, size lines and mark lines can differ in colors so as to be manually distinguished from each other by persons associated with the custom-made facility 100. Alternatively, the different types of marks can be distinguished from each other automatically by computer program 24 (for example, commercially available image editors such as ADOBE PHOTOSHOP (trademark of, and available from, Adobe Systems Inc. of San Jose, Calif.) can distinguish lines by color and so a full-auto program can be developed). In a preferred embodiment, computer program 24 is one program or complete set of programs that can both control the operation of scanner system 10, retrieve and convert the scanned image data to a desired file format, distinguish the mark lines from other lines and markings in the scanned image, and further adjust the mark lines as will be described in more detail below. Alternatively, separately available programs such as ADOBE PHOTO SHOP and ADOBE ILLUSTRATOR (trademarks of, and available from, Adobe Systems Inc. of San Jose, Calif.), which include routines that can recognize the mark lines by contrasting the color with the background color of the sample garment pieces, can be used along with other commercially available or proprietarily developed programs.

Further to another aspect of the invention, the computer system 22 further includes programs 24 that allow a tailor or other person associated with the custom-made garment facility 100 to check or revise the mark lines 52. Other adjustments to the mark lines, such as the addition of salvage, shrinkage amount, and other parameters can be made manually or automatically. In one embodiment, the tailor checks the mark lines 52 on the sample garment 50 by viewing the image data 54 on the monitor 78. The mark lines can be adjusted in the image data 54 and the adjustments can be recorded. For example, such adjustments can be made using commercially available software such as PATTERN AID DESIGNING (PAD) system software (details available at http://www.padsystem.com/en/Software MPD.html or from PAD System Technologies Inc. of Montreal (Quebec) Canada). If the scan image is converted to the DXF file format, the PAD system software can import the file directly. For resulting output data, DXF format is also preferable since it can than be directly sent to cutting machine 30. The DXF format is widely used in the apparel CAD/CAM industry and supports color images.

One possible scanner system for use in the present invention is depicted in FIG. 4A. The scanner includes motors 74, which operate one or more scanner heads 72. One motor 74*a* controls movement of the scanner head 72 in one direction (e.g. the X-axis), while the other motor 74*b* controls movement of the scanner head in a second direction (e.g. the Y-axis). The scanner head 72 provides one or more cameras for acquiring the image of a garment. Optionally, one or both of the scanner heads can also be fitted with an ink jet head, such as for further marking the garment, as will be described in more detail below.

In one embodiment, the scanner system 10 comprises a transparent table surface 76 and two cameras (stored within the head units 72), one positioned above the table (head unit 72*a*) and one positioned below the table (head unit 72*b*). By positioning the pattern pieces on the transparent table, both sides of the pattern pieces can be scanned simultaneously.

Alternatively, a first camera scan can be made, then a second scan is made. In one example, the table includes air holes 88 connected to a vacuum or compressor (not shown) for producing suction against the pattern pieces. This prevents the pattern pieces from moving during the scanning operation.

Referring now to FIG. 4B, an alternative embodiment of scanner system 10 could further include a pattern holder 12, to hold the pattern pieces in a flat position. Pattern holder 12 is preferably constructed, using plexiglass for example, as a flat, transparent containment vessel, inside which one or more of the various pattern pieces are positioned. The pattern holder 12 can be arranged in different ways to hold the pattern pieces properly. In using a pattern holder 12, a single camera scanner system may be used. After scanning one side of the pattern, holder 12 could be flipped to allow the opposite side to be scanned. Care must be taken to ensure that the pieces of the pattern do not move between scans. Those of ordinary skill in the art recognize that a number of mechanisms for recording visual images are available, and that reference to scanners in the description represents but one of many possibilities for practicing the invention.

The digitized data, or customer data 20, thus includes a digital representation of each piece of the customer-marked sample garment 50, as specified by the customer and as enhanced by the tailor and/or software program 24 (including salvage, shrinkage amount, and other parameters). With the customer data 20, the sample garment 50 can thus be reproduced at any time.

Ideally, no paper pattern is generated. Instead, the customer data 20 is sent directly to a cutting machine 30, the desired material for the garment is selected, and the material is cut using the customer data 20. Thus, the cutting machine uses the customer data 20 instead of a printed pattern to determine where to cut the material. If desired, however, a pattern can be printed on paper and cut using the customer data 20. The more traditional paper pattern can then be used to manually cut garment pieces from fabric, a technique well-known in the garment industry.

FIG. 5 illustrates in more detail a complete set of base patterns 210 used to produce a sample garment (a pair of pants, for example). The base patterns 210 can be front leg pieces 110, back leg pieces 120, back yokes 160, a waist belt 170, back pockets 130, and front pockets 140. These base patterns 210 are just one subset of many possible base patterns that can be retrieved from one type and style of try-on garment 200 when creating the sample garment 50.

As shown in FIG. 5, the base pattern 210 can be marked with size lines running along the outer boundaries of the base pattern 210 (in FIG. 5 the waist belt 170 and pockets are not marked, but could also be marked with such lines). In one embodiment, each contiguous one of these lines represents a distinct size of the garment piece. Accordingly, a first size line 122 indicates a first reference size for the garment piece. A second size line 124 represents one size larger than the reference size 122. A third size line 126 represents one size smaller than the reference size 122. Although three size lines are depicted, the pieces can have just one size line or a number of size lines, each representing a different size of the garment piece.

Further, guide-lines 128 can be included to help the tailor locate the distance from each size line, or other lines familiar to those of ordinary skill in the art can be depicted for more detail indication. Leg length lines 118 can further be used by the tailor to size the garment for the customer. Pocket position lines 116 are used as reference lines to position the back pocket.

Additionally, in one embodiment, some pieces of the base pattern 210 include a horizontal line 112 and a vertical line 114, and point of origin 106. The horizontal and vertical lines, and point of origin can be used as reference lines and a reference point, respectively, such as when multiple styles of try-on garments 200 are combined to produce a unique sample garment style, as will be described in more detail below.

Figure 6:
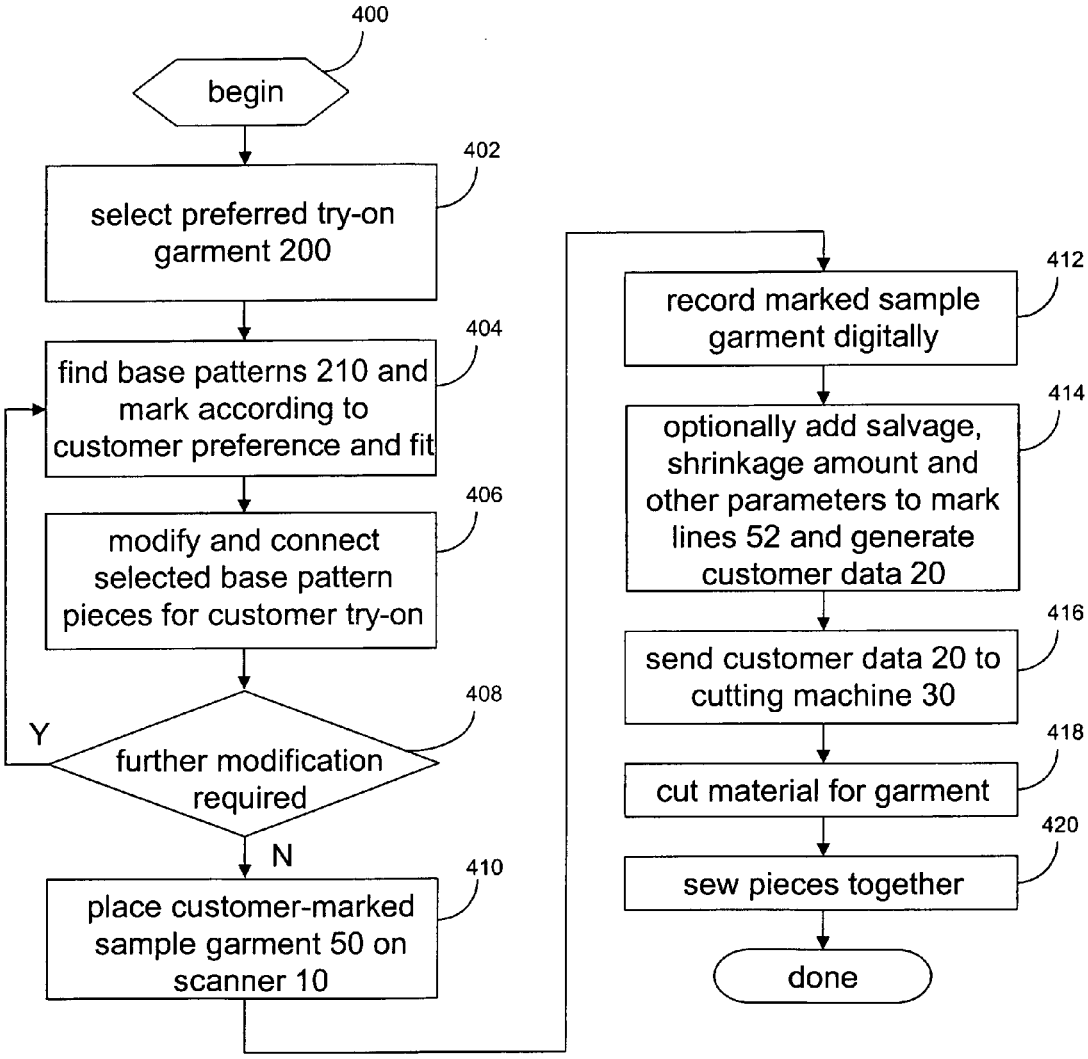
FIG. 6 is a flow diagram illustrating operation of the custom-made garment facility of FIG. 1 in accordance with a preferred embodiment of the present invention.

FIG. 6 illustrates a flow diagram that describes an example operation of the custom-made garment facility 100, according to one embodiment. Initially, the customer selects a try-on garment 200 (block 402), from which one or more associated base patterns 210 are retrieved. The base patterns 210 are marked by a tailor (block 404), as described above, to account for the customer's body contour and preferences in fit and style. The tailor then modifies and connects the one or more base pattern 210 pieces to create a sample garment 50 that the customer can try on (block 406). In one embodiment, the tailor obtains the one or more base patterns 210 based upon the TID 46 or other identifier stored in the database 250.

Since the sample garment has been modified and connected based upon the customer fit preferences and body contour, no further modification should be required, but if the customer prefers further modification—for example, a snug fit in one section of the garment—the tailor can preliminarily mark the sample garment while on the customer, and then re-adjust the sample garment starting once again from re-marking the base pattern (block 408). Additionally, the customer's preferences for length of the garment, pocket position, pocket shape, and other features can be made. Such sizing features are familiar to those of ordinary skill in the clothing industry.

The mark lines 52 on each base pattern 210 comprising the sample garment indicate the modification of the design as well as the position of the marked piece in relation to one or more other base pattern pieces. Mark lines 52 are preferably made using a highly visible, but erasable or naturally disappearing medium, such as a disappearing CHAKO pen, chalk, ink, or other medium (available from Adger Kogyo Co., Ltd. of Japan) that remains on the base pattern for only a limited duration.

After the tailor marks the base pattern, the mark lines 52 may, in some cases, be broken (i.e. unconnected). The tailor can extrapolate from the various mark lines a more contiguous, smooth line, such as by using a ruler. Alternatively, in another embodiment, once the customer-marked sample garment is scanned, the software program 24 running on the computer system (e.g. PAD system software) can be used by the tailor to manually extrapolate a smooth mark line from a plurality of broken, non-contiguous ones. It is further possible that software can be designed to automatically extrapolate contiguous mark lines using pattern recognition or other techniques.

In some prior art custom-fitting operations, a customer wears a sizing garment upon which sizing indicators are present. Sizing indicators can be elaborate, such as using color-coded, alphabetical or numerical markings, and the like. The tailor fits the garment according to the customer preference, then records the sizing indicators, usually a series of numbers, letters, or other indicia representative of how the pieces of the sizing garment fit relative to one another. The recording may be on a custom-made order form or on a blank slip of paper.

Unfortunately, by recording the sizing indicators only, subsequent inspection of the garment can be checked only with respect to the recorded sizing indicators. Because the sizing indicators were recorded according to a visual inspection, an error is possible, but not discoverable, until the custom-made garment is tried on. In other words, if the tailor or other facility employee incorrectly records the sizing indicators, there is no way to inspect the final product for accuracy.

In contrast, the custom-made garment facility 100 of the present invention records the actual sizing information (e.g. the mark lines 52 for each marked up piece of the sample garment) by producing an actual visual image of the piece. The scanner system 10 thus records both the pieces and the mark lines thereon. At a later time, the customer data 20 can be retrieved as an actual visual image of what was scanned. Instead of having written information about what the tailor saw (i.e. a translation), the tailor's actual markings on the sample garment pieces are recoverable by the custom-made garment facility 100 for an indefinite period of time.

Returning to FIG. 6, once the mark lines 52 are drawn on each sample garment pattern piece, the pieces are placed on the scanner (block 410) to generate customer data 20. In one embodiment, the sample garment 50 can be taken apart and each component piece of the sample garment can be scanned individually in two dimensions. Alternatively, holder 12 can be used to hold the sample garment to be scanned without taking the sample garment apart, using a "favorite garment" procedure as will be described below for example. Images of both the mark lines 52 and the pattern pieces are recorded (block 412). If desired, the customer data 20 is modified to account for salvage, shrinkage amount and other parameters (block 414).

Once the customer data 20 is generated by the computer system 22, it is sent to a cutting facility such as the cutting machine 30 (block 416). As mentioned above, the cutting facility can be physically remote from the scanner system 10. Transmitting digital data to a remote facility can be accomplished in numerous ways familiar to those of ordinary skill in the art, such as via a data communications network including the Internet. Once the cutting facility receives the necessary customer data 20, material for the garment is cut (block 418). The cut materials (i.e material corresponding to each of the customized base pattern pieces 210) are then sewn together (block 420) in a manner customary in the garment industry to form the custom-fit garment 300.

Figure 7A:
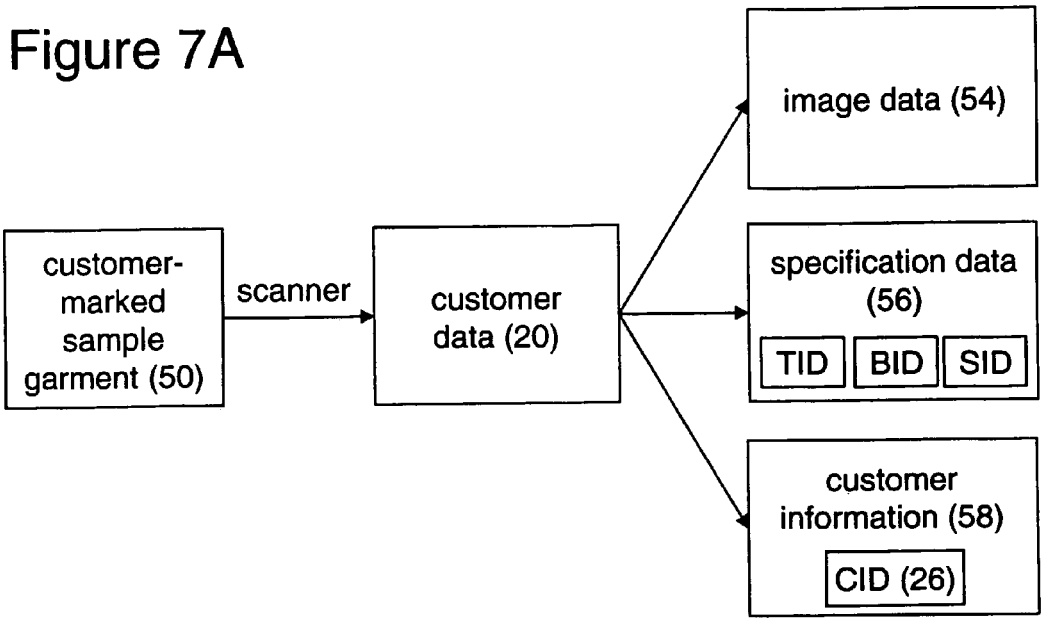
FIG. 7A is a schematic diagram illustrating the recoverability of image data, specification data and customer information from the customer data according to a preferred embodiment of the present invention.

FIG. 7A shows that, as the customer-marked sample garment 50 is scanned into digitized customer data 20, image data 54 corresponding to the sample garment is obtained. Further, non-image data, such as specification data 56, and customer information 58 is generated, in one embodiment. This additional data is described in more detail below.

Image data 54 generated from customer data 20 may have been modified to include parameters such as salvage, shrinkage amount, easing amount and so on. Thus, the image data 54 can represent a modification of the customer-marked sample garment 50, as originally scanned. However, since additional parameters can be added automatically, such as by the software program 24, or manually, these parameters can likewise be removed automatically or manually. Therefore, the image data 54 can either be a representation of the customer-marked sample garment 50 or the customer-marked sample garment after the additional parameters are included.

The specification data 56 is non-visual data that has been added to or extracted from the visual scanned image data 54. Data added to the image data includes the salvage, shrinkage amount, and other parameters that are used to change the mark lines 52. Specification data 56 that has been extracted from the image data can indicate length and width of a pattern piece, distance of the mark lines from a point of origin 106 in X-Y coordinates, and so on. This data can be in a DXF or other file format. In one embodiment, specification data can further include try-on garment identifier (TID), base pattern identifier(s) (BID) and sample garment identifier (SID) to identify try-on garment, base pattern(s), and sample garment, respectively, that have been used and assigned at the time of the customer's order.

Figure 7B:
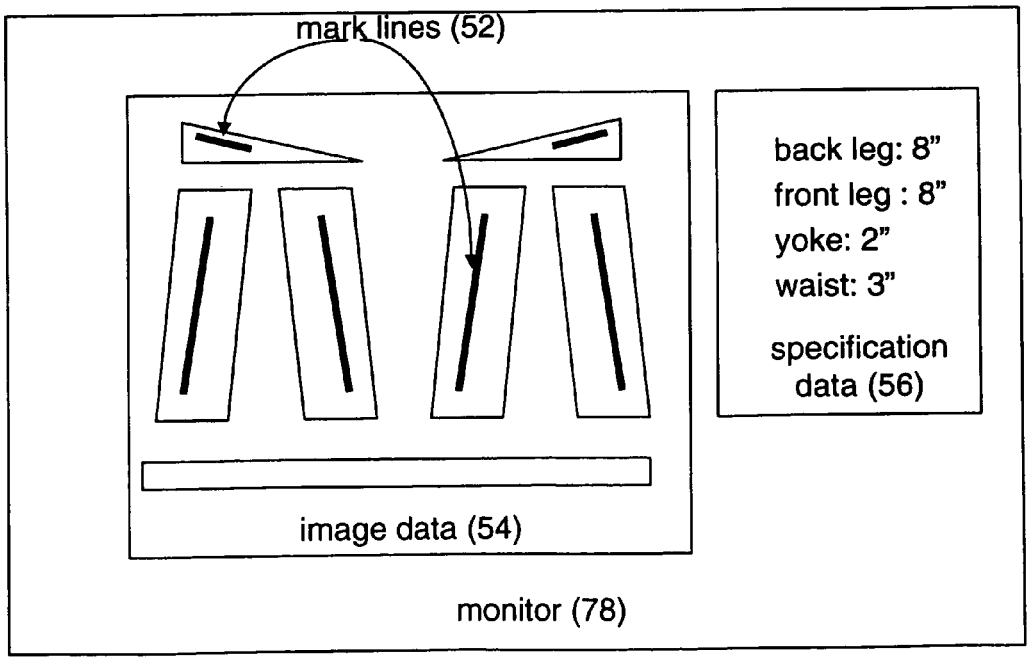
FIG. 7B is a schematic representation illustrating the availability of image data, specification data, and customer information from the customer data according to a preferred embodiment of the present invention.

Because of the ease with which digital data can be reproduced, the image data 54 and the specification data 56 can be retrieved from a workstation located at the sewing site. The workstation may be a personal computer, a mainframe computer/terminal, or other processor-based system that is capable of displaying both the image data 54 and the specification data 56. In FIG. 7B, for example, image data 54 and specification data 56 can be presented to the monitor 78, such as a computer display coupled to the processor-based system. Further, multiple workstations can simultaneously access the image data and the specification data for a single customer, as needed.

In addition to producing custom-made garments 300 deriving from a single try-on garment 200, the custom-made garment facility 100 allows multiple try-on garments to be combined, such that, essentially, a new sample garment 50 is produced for the garment.

Figure 8:
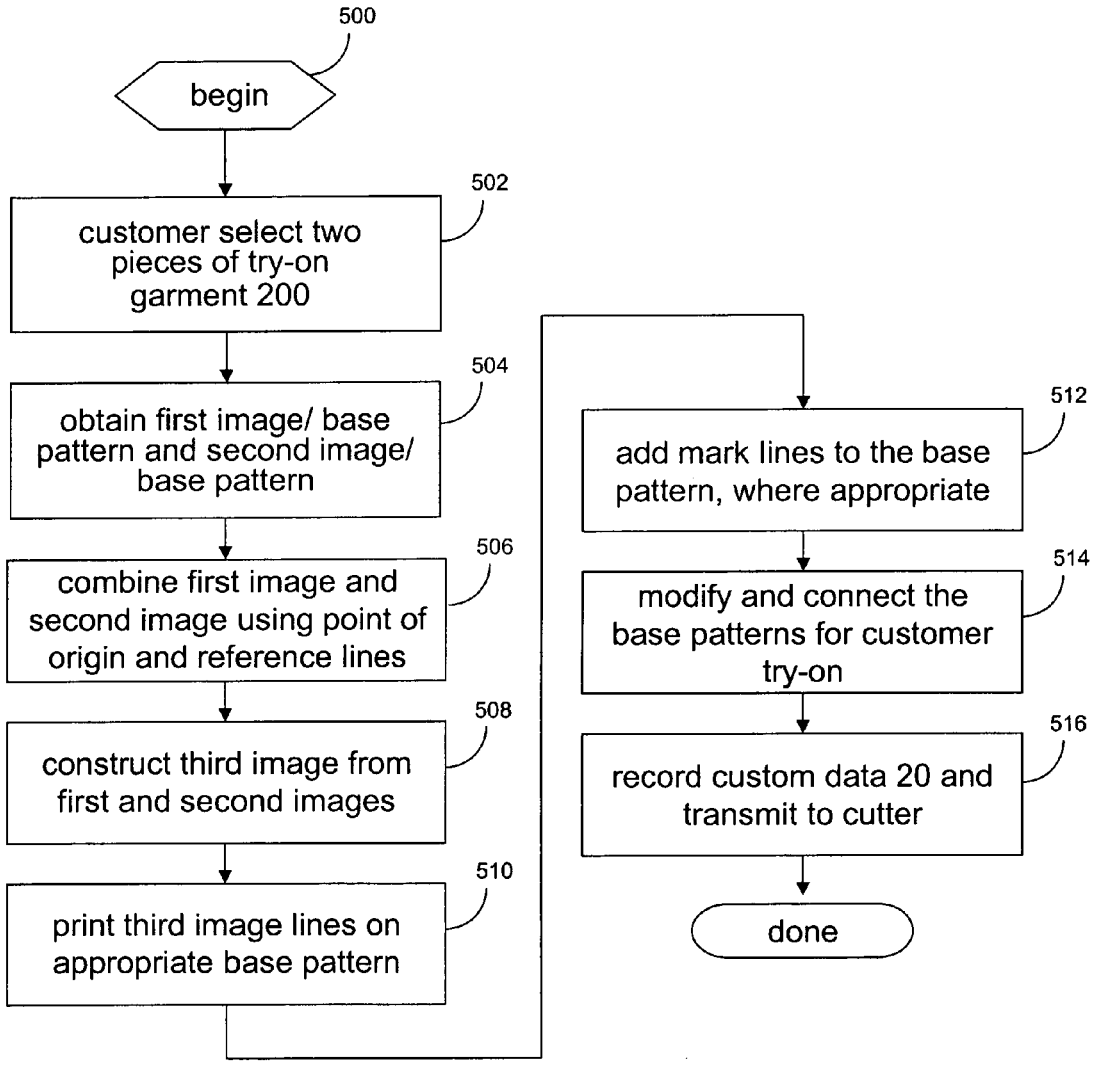
FIG. 8 is a flow diagram illustrating operation of one example of the custom-made garment facility of FIG. 1 when plurality of try-on garments selected by the customer are combined to create a new style of sample garment according to a preferred embodiment of the present invention.
Figure 9:
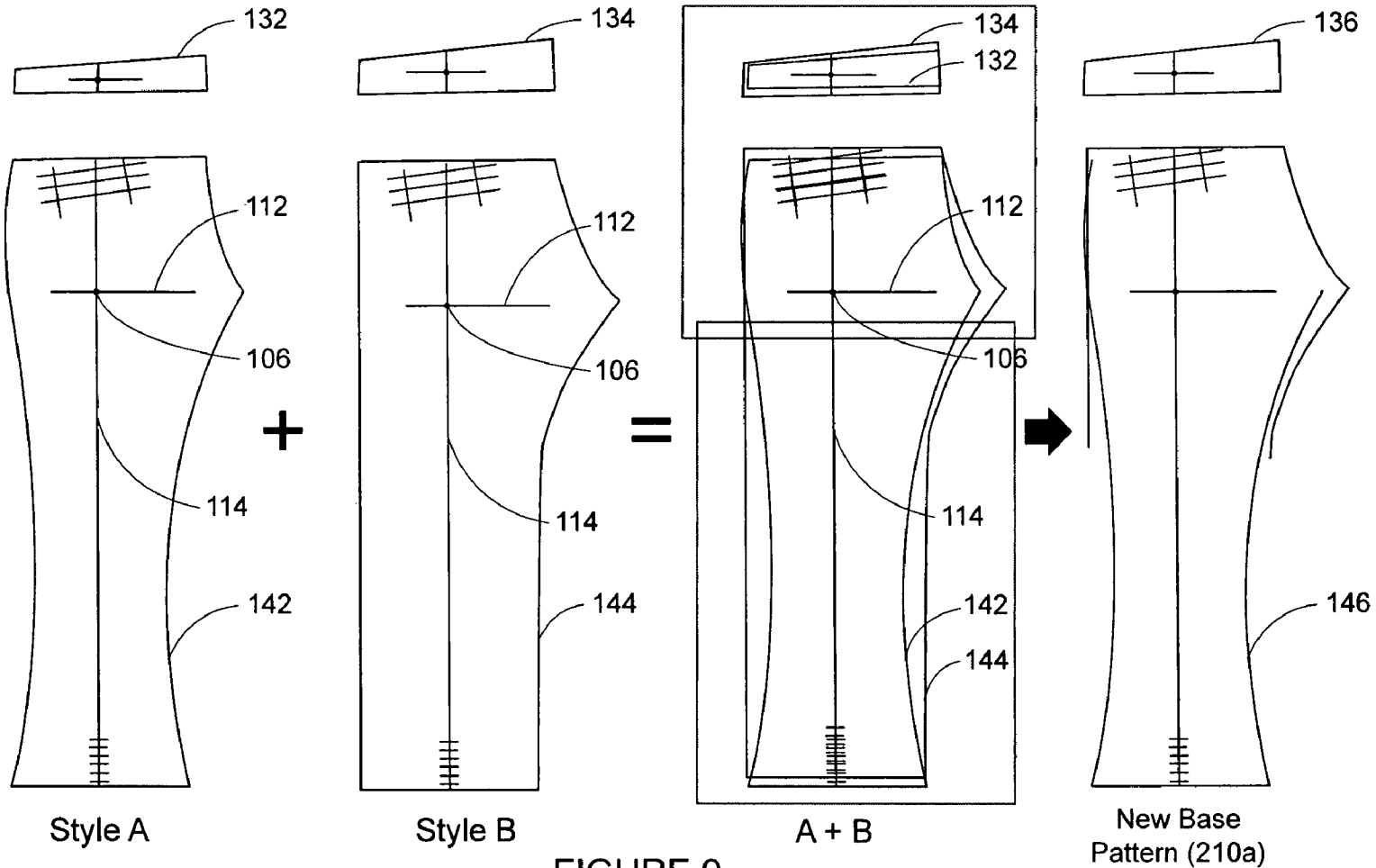
FIG. 9 shows schematic diagrams illustrating how base patterns are combined according to a preferred embodiment of the present invention.

Operations for combining two try-on garments, according to one embodiment, are depicted in the flow diagram of FIG. 8 and schematic diagram of FIG. 9. The operations of FIG. 8 and FIG. 9 are described with reference to an example using two try-on garments 200 and their associated base patterns. However, the principles described can be extended to include any number of try-on garments and associated base pattern(s).

In FIG. 8, the customer selects two try-on garments 200 from the try-on garments available at the custom-made garment facility 100 (block 502). Based upon the selected try-on garments, associated base patterns 210 for a first one of the try-on garments are retrieved, and scanned as a first image data 54. Subsequently, the second try-on garment associated base patterns are retrieved and scanned as second image data 54 (block 504).

Alternatively, the first and second try-on garments 200 need not be scanned to obtain the base pattern image data 54. Instead, TIDs 46 associated with each try-on garment are entered into the computer system. From each TID, relationally linked BIDs 48 and their base pattern image data 54 can be obtained from the database 250. Likewise, SID 32 printed on or attached to the custom-made garment 300 can be used to retrieve its base pattern image data 54, and combined with the try-on garment image data 54 to create a new sample garment.

Once the try-on garment images are obtained, the two images are combined (block 506). In one embodiment, reference lines, such as the horizontal 112 and vertical 114 lines, and reference points, such as point of origin 106 are used to help combine the images. Next, a third image is constructed from the combined images (block 508).

By using the ink jet head 72*a* on the scanner system 10, the third image is printed onto the first or second base pattern (or other appropriate base pattern) which will be able to fit all the third image lines on the ears 214 to produce a third, customized, base pattern (block 510). Where appropriate, mark lines 52 are further added to the base pattern to extrapolate a smooth mark line from a plurality of broken, non-contiguous ones (block 512). The tailor then modifies and connects the one or more base patterns 210 to create a sample garment 50 that the customer can try-on (block 514). Finally, the customized sample garment is recorded and transmitted to a cutter (block 516), completing the operation.

When the scanner system 10 prints the third image lines on the appropriate base pattern 210, first, the camera installed in head 72 recognizes and records the position of the base pattern on the scan table 76. The tailor can then superimpose the third image data 54 with the base pattern on the scan table 76 using the computer system 22 and conduct the printing of the mark lines on the appropriate position. In one embodiment, software program 24 can automatically superimpose the two images in a certain position just by relying on the horizontal 112 and vertical 114 reference lines and point of origin 106.

Referring now to FIG. 9, a leg pattern piece 142 (style A) is combined with a second leg pattern piece 144 (style B) to produce a new leg pattern piece 146 (A+B). Likewise, back yoke 132 and back yoke 134 are combined as back yoke 136. In the combined leg pattern piece 146 and the back yoke 136, the horizontal 112 and vertical 114 reference lines are superimposed. From the combined pattern pieces (A+B), a new base pattern 210*a* is formed. Where the pattern outlines do not meet exactly, some adjustment of the lines are made. This adjustment can be made by the tailor or by the software program 24.

During the combination operations, if a first try-on garment is sized for a loose fit, then a second try-on garment being combined with the first is generally also sized for a loose fit. The more compatible the sizing operations, the more likely the mark lines will be compatible when the patterns are combined. However, incompatible sizing is possible, depending on, for example, the styles being combined, the expertise of the tailor, and the desire of the customer.

The combination operations can be performed using rulers or other tools known in the art for connecting broken lines and otherwise interpolating between the two or more try-on garments. Alternatively, the combinations can be achieved using the computer system 22. Depending on the number of try-on garments 200 and base patterns 210 available at the custom-made garment facility 100, or image data 54 available in the database 250, the ability to combine patterns can increase available styles for customizing the garments.

Figure 10A:
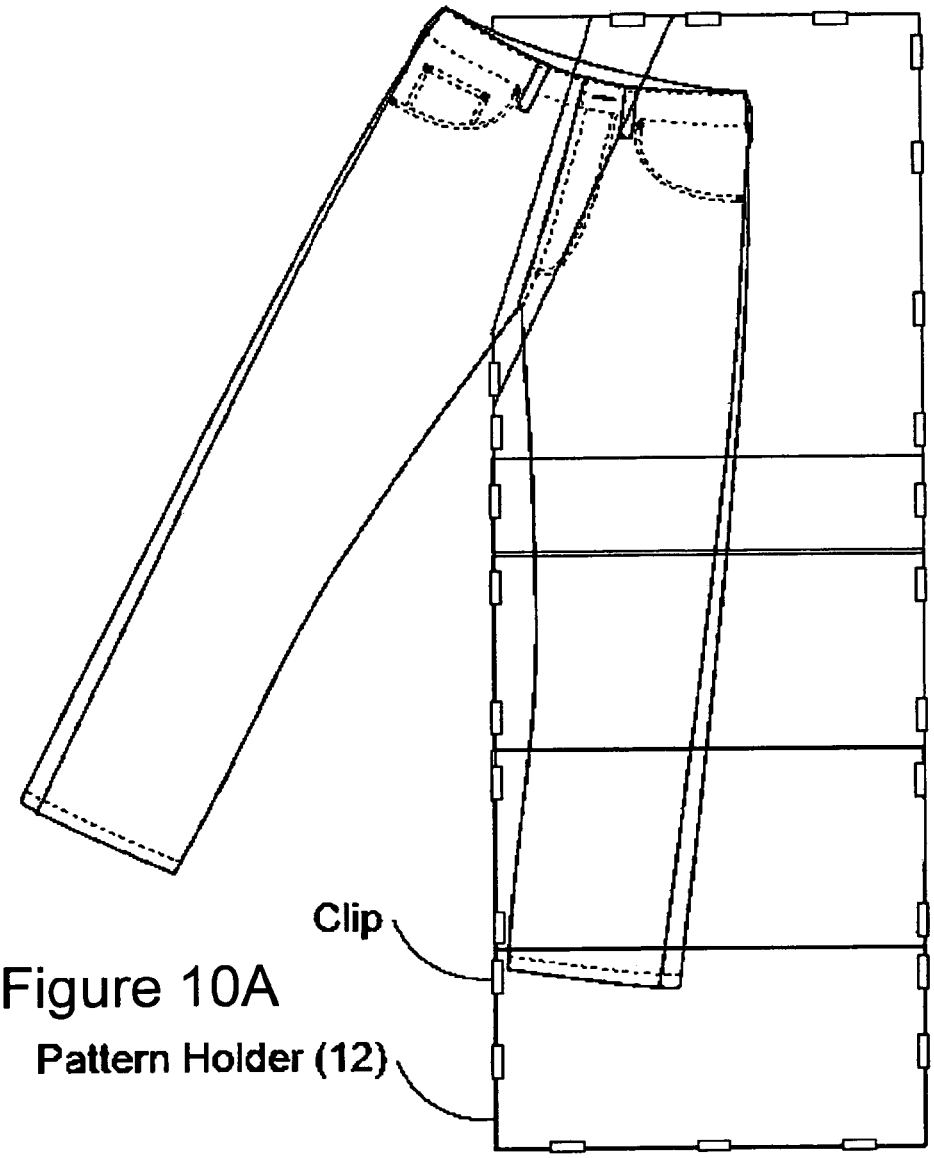
FIGS. 10A and 10B are drawings illustrating a garment before and after scanning according to a preferred embodiment of the present invention.
Figure 10B:
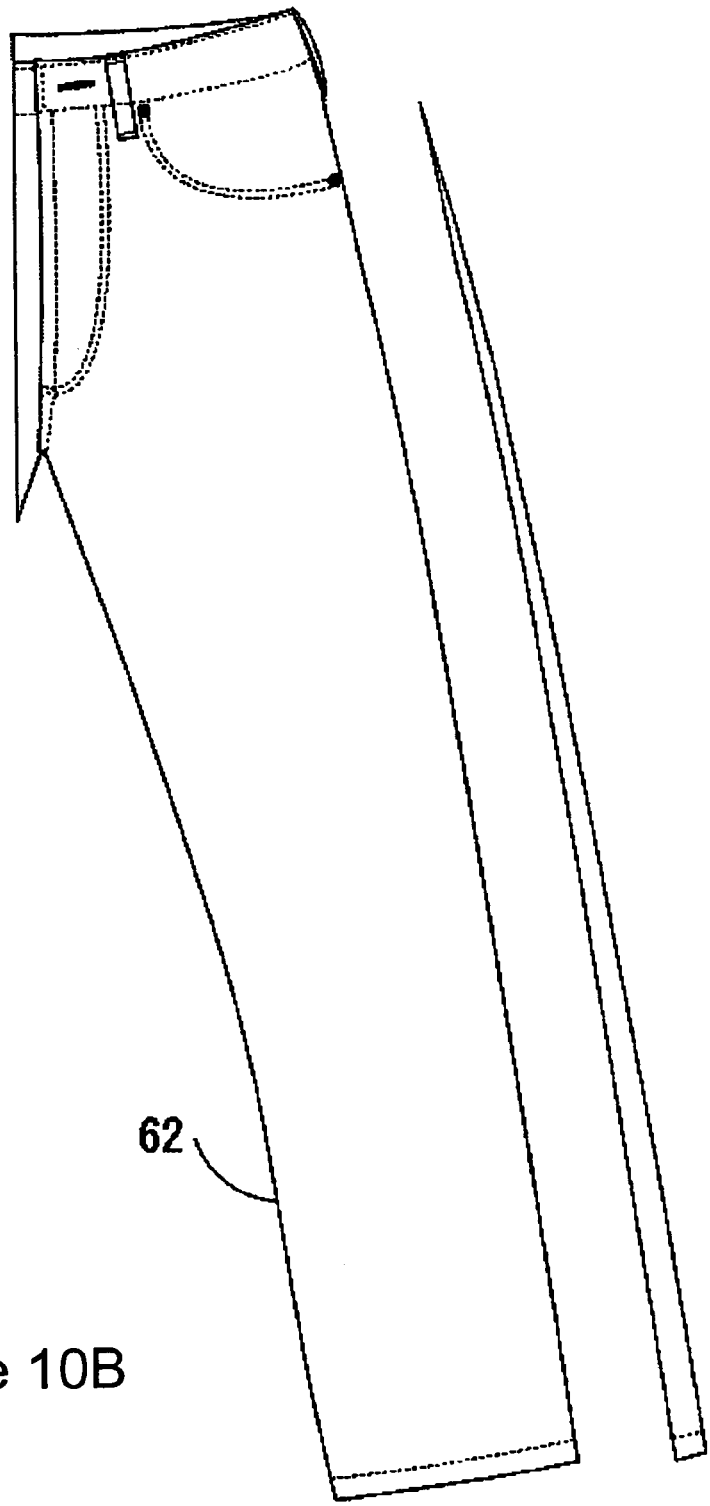
Figure 11:
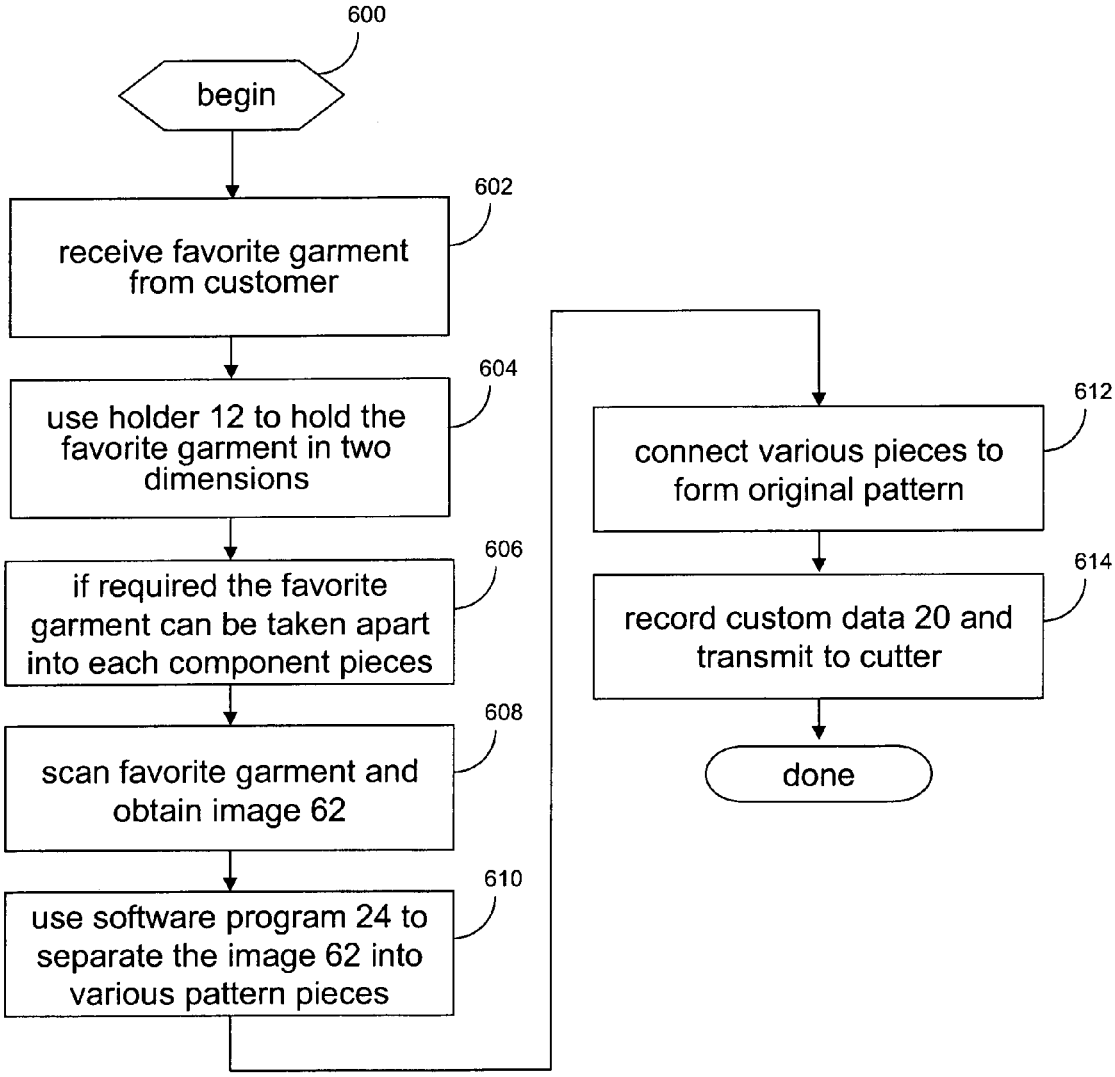
FIG. 11 is a flow diagram illustrating operation of one example of the custom-made garment facility of FIG. 1 when custom-fit garment is produced from favorite garment according to a preferred embodiment of the present invention.

Further, as depicted in FIGS. 10 and 11, the custom-made garment facility 100 can receive a "favorite" garment from the customer to be scanned and stored for use by the garment facility 100. A flowchart depicting an example process for converting the favorite garment into digital design data is shown in FIG. 11. In one embodiment, after receiving the garment from the customer (block 602), the favorite garment is placed and held in a holder, such as the pattern holder 12 of FIG. 4B. The holder 12 can hold the garment in a flattened position so that the garment will appear in two dimensions, without having to take the garment apart, as shown in FIG. 10A, for example (block 604). The garment can then be scanned and recorded. Depending on the garment, different parts of the garment may be scanned separately. A scanned image 62 is shown in FIG. 10B, according to one embodiment (the sliver of fabric on the right side is part of the left front leg piece that has been cut out. It will be connected to the left back leg piece to form the original left back leg pattern, as will be described below).

Alternatively, the garment can be taken apart and each component piece of the garment can be scanned individually in two dimensions. Such may be the preferred method when the garment has darts, for example. A customer may bring in a favorite garment such as a skirt that the original maker no longer produces (block 606). At the custom-made garment facility 100, the garment is taken apart, a scanned image 62 is obtained (block 608).

The newly scanned garment is divided into two-dimensional base patterns in the computer system 22 by the software program 24, according to one embodiment. The software program 24 can automatically or manually find the seam in the garment and separate the scanned image into various pattern pieces (block 610). Commercially available programs such as ADOBE PHOTOSHOP or ILLUSTRATOR (trademarks of, and available from, Adobe Systems Inc. of San Jose, Calif.) can be used for this separation and combination of pattern pieces. After all the pieces are connected and the original patterns are formed they can be preserved as image data 54 (block 612). For example, as shown in FIG. 10B, the sliver from the left front leg piece that has been cut out will be connected to the left back leg piece to form the original left back leg pattern. In this manner, an original pattern of a customer's favorite garment can be produced at the custom-made garment facility 100, and new customer data 20 for the garment can be generated (block 614).

The newly scanned garment can be added to the database of base patterns 210, in one embodiment. For example, if a customer brings in a vintage pair of pants to a site associated with the garment facility 100, an image of this pair of pants can be scanned and used to obtain design data as described above. In this manner, custom-made garments deriving from this vintage pants style or from other scanned garments can be made available to other customers. Further, the newly scanned garment can also be combined with other base patterns, for a whole new look.

Figure 12:
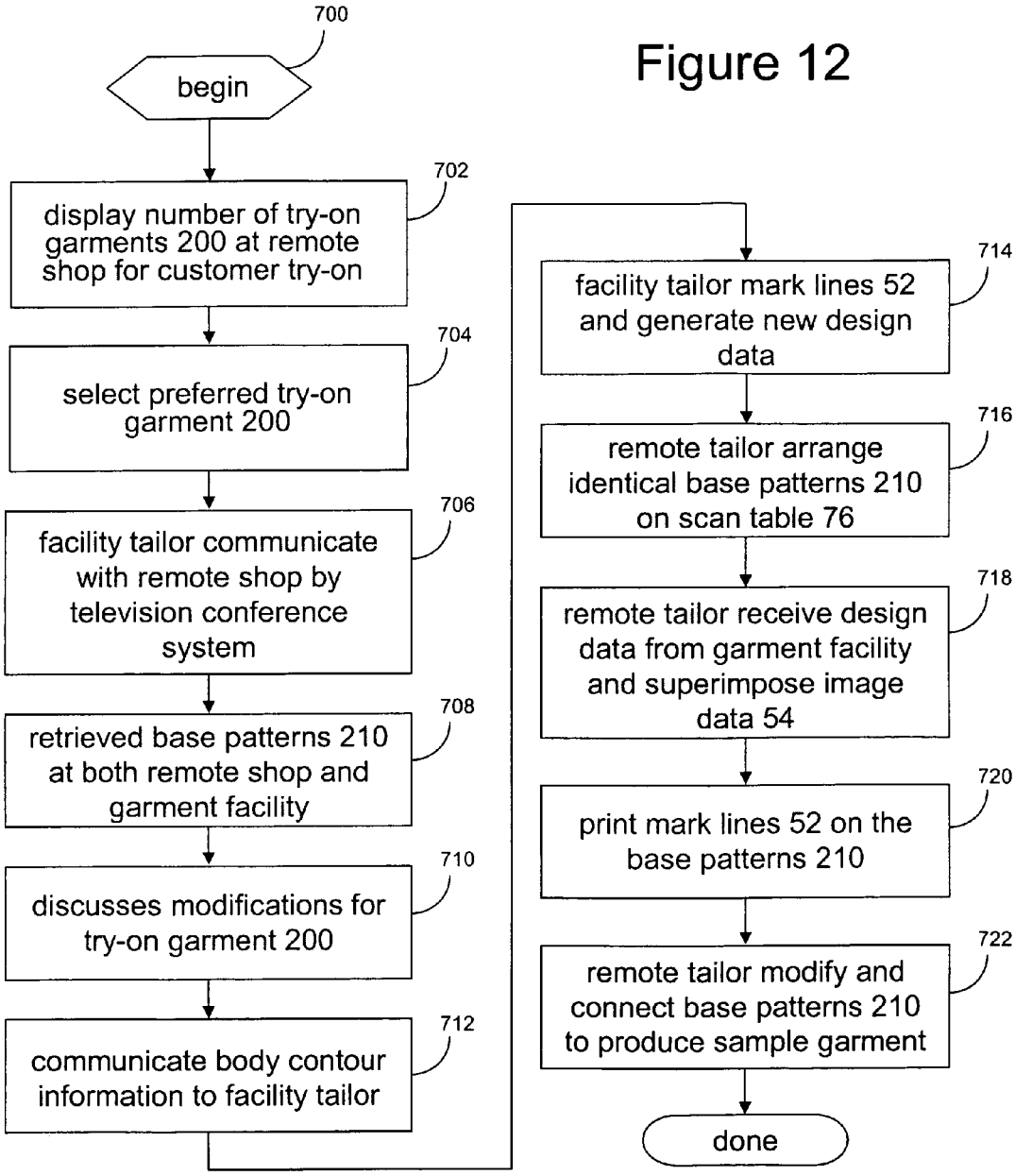
FIG. 12 is a flow diagram illustrating operation of one example of the custom-made garment facility of FIG. 1 when facility tailor design the custom-fit garment in a remote location according to a preferred embodiment of the present invention.

Alternatively, depicted in FIG. 12, the custom-made garment facility 100 can also operate with remote sizing facilities (remote shops) located remotely from the custom-made garment facility. A person associated with the remote shop (e.g. an employee such as a tailor) will display a number of try-on garments 200 which a customer can try on (block 702).

After the customer finds the try-on garment 200 which he or she prefers (block 704), the remote tailor will communicate with a person associated with the custom-made garment facility 100 (e.g. a facility tailor). In one embodiment, the facility tailor communicates with the remote shop such as by a television or Internet conference system, including camera, microphone, speaker, and the like (block 706). The facility tailor may be more experienced than the remote tailor in preparing the custom-fit garment.

As explained above, each try-on garment 200 is preferably associated with a TID 46, for uniquely distinguishing the try-on garment from others. In the database 250, TID 46 and BID 48 are relationally linked, and each TID is used to identify and retrieve one or more BIDs associated with base patterns 210 comprising the try on garment 200 automatically. Accordingly, the facility tailor can retrieve associated base patterns 210 comprising the try-on garment, or the try-on garments themselves, using the identifiers at the garment facility. The retrieved base patterns and the tryon garment at both the remote shop and the garment facility 100 are identical (block 708). The facility tailor discusses the modifications desired by the customer of the selected try-on garment 200 over the television or other conference system (block 710). The remote tailor assists by measuring the customer's body length, etc., at the remote shop and communicating the information to the facility tailor at the custom-made garment facility. Alternatively, a three-dimensional scan system can be used at the remote shop, where appropriate, for automatically communicating the body contour information to the facility tailor (block 712). In another embodiment, the remote tailor can contact another remote tailor in another location, instead of the facility tailor.

Based upon the information received from the remote shop, the facility tailor places mark lines 52 on the retrieved base patterns 210 to modify the design. The facility tailor then scans the marked base patterns to generate its new design data (image data 54 and specification data 56) (block 714). At the remote shop, the remote tailor simultaneously arranges one or more of the identical base patterns on a scan table 76, according to one embodiment (block 716). After receiving the new design data from the garment facility, the remote tailor will superimpose image data 54 of the new design data onto the base patterns using the computer system 22 (block 718). Computer networking or other technology known in the art can be used to transmit the new design data from the garment facility to the remote shop. The ink jet head installed in the scanner head 72*a* will print the mark lines 52 of the new design data onto the appropriate position (block 720). The reference lines and point of origin on the base pattern 210 will help the remote tailor manually, or automatically using computer system 22, to properly position the mark lines 52 onto the base patterns, as described above.

In one embodiment, the facility tailor in the garment facility can use the computer system 22 to display the base pattern on the monitor 78, and manually mark lines 52 on the image data 54, using a software program 24, to conduct the remote designing without arranging any base patterns. Furthermore, the facility tailor can have on-line access to the computer system 22 and scanner system 10 housed in the remote shop from the garment facility to conduct the remote operation of computer system 22 and scan system 10, according to methods well known in the factory automation industry. After the mark lines are printed on the base patterns in the remote shop, the remote tailor can modify and connect the base patterns based on the mark lines, and produce the sample garment 50 for customer try-on (block 722).

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

What is claimed is:

1. A system for producing a custom-made garment for a customer, comprising:

a base pattern capable of accepting mark lines indicating how the base pattern is connected with other base patterns in accordance with preferences expressed by the customer, the base pattern further capable of being connected to the other base patterns to comprise a style of a type of garment;

a scanning system for producing an image of the marked base pattern; and a computer system that receives the image of the marked base pattern from the scanning system, determines the locations of the mark lines therefrom, and generates specification data from the image.

2. A system according to claim 1, wherein the base pattern includes guide marks that are useful for locating and placing the mark lines.

3. A system according to claim 2, wherein the guide marks include a plurality of size lines corresponding to different garment sizes.

4. A system according to claim 2, wherein the guide marks include reference marks and a point of origin associated with the base pattern.

5. A system according to claim 1, wherein the specification data specifies dimensions of the base pattern as adjusted by the mark lines.

6. A system according to claim 5, further comprising a cutting system that receives the specification data and cuts fabric having the dimensions of the adjusted base pattern.

7. A system according to claim 6, wherein the cut fabric is sewn to produce the custom-made garment.

8. A system according to claim 6, wherein the cutting system is located remotely from the scanning system.

9. A system according to claim 6, wherein one or more of the scanning system, the computer system and the cutting system communicate with one of the other systems using a data communications network.

10. A system according to claim 5, further comprising a database that stores the specification data.

11. A system according to claim 10, wherein the database further stores information about the customer, and associates the specification data with the customer.

12. A system according to claim 1, wherein the scanning system includes a transparent holder for holding the base pattern during scanning.

13. A system according to claim 12, wherein the transparent holder is a substantially flat transparent containment vessel having separated top and bottom pieces, the top and bottom pieces being adapted to be separated to receive the base pattern, and further adapted to be fastened together to hold the received base pattern in a substantially two-dimensional fashion.

14. A system according to claim 1, wherein the scanning system includes suction means for holding the base pattern in place during scanning.

15. A system according to claim 1, wherein the scanning system holds the base pattern flat during scanning, and wherein the scanning system includes means for scanning both a top and bottom side of the base pattern.

16. A system according to claim 1, wherein the base pattern includes one or more side cuts that define one or more ears, the mark lines being placed on the ears.

17. A system according to claim 16, wherein the mark lines are placed on the ears so as to modify the design of the base pattern.

18. A system according to claim 1, wherein the mark lines are made using a highly visible medium.

19. A system according to claim 18, wherein the highly visible medium is one of a Pen, chalk and ink, each being erasable or naturally disappearing.

20. A system according to claim 1, wherein the base pattern is connected with the other base patterns to form a sample garment using a securing means.

21. A system according to claim 20, wherein the securing means is one of snaps, tape, mutually engaging hook and loop fabric, and thread.

22. A system according to claim 1, wherein the computer system includes a monitor for displaying the scanned image.

23. A system according to claim 1, wherein the computer system includes software for controlling the scanning system.

24. A system according to claim 1, wherein the computer system includes software for use in adjusting the mark lines.

25. A system according to claim 24, wherein the adjustments are made in accordance with parameters that include one or more of salvage, shrinkage amount and easing amount.

26. A system according to claim 1, wherein the computer system includes software for use in adjusting the mark lines before generating the specification data.

27. A system according to claim 1, wherein the scanning system is located remotely from the computer system.

28. A system according to claim 1, further comprising a database that associates the base pattern with a base pattern identifier (BID).

29. A system according to claim 1, wherein a sample garment of the custom-made garment is made in accordance with the marked base pattern, the sample garment being useful for confirming and modifying the preferences of the customer for the custom-made garment.

30. A system according to claim 29, further comprising a database that stores information about the customer, and associates an identifier of the sample garment (SID) with the customer.

31. A system according to claim 30, wherein the SID is visible on the custom-made garment.

32. A system according to claim 30, wherein the database further associates the base pattern with a base pattern identifier (BID), the BID being linked to the SID.

33. A system according to claim 1, further comprising a try-on garment that is used to identify and retrieve the base pattern, and is further useful for locating and placing the mark lines.

34. A system according to claim 33, further comprising a database that associates the try-on garment with a try-on garment identifier (TID) and associates the base pattern with a base pattern identifier (BID), the BID being linked to the TID.

35. A system according to claim 34, wherein the TID is visible on the try-on garment.

36. A system according to claim 35, wherein the base pattern is retrieved after the customer selects the try-on garment and the linked BID is retrieved from the database using the TID.

37. A system according to claim 1, wherein the mark lines are placed on the base pattern during a custom-made garment order process involving the customer.

38. A method of producing a custom-made garment for a customer, comprising:

preparing a base pattern;

placing mark lines on the base pattern indicating how the base pattern is connected with other base patterns in accordance with preferences expressed by the customer, the base pattern further capable of being connected to the other base patterns to comprise a style of a type of garment;

scanning an image of the base pattern;

determining the locations of the mark lines on the base pattern; and generating specification data from the image.

39. A method according to claim 38, further comprising:

identifying the base pattern from one or more previously created try-on garments that represent a respective style of a type of garment selected by the customer.

40. A method according to claim 39, further comprising:

locating and placing the mark lines using identical indicia on the try-on garment and the base pattern.

41. A method according to claim 39, further comprising:

temporarily connecting one or more base patterns associated with the try-on garment to form a sample garment.

42. A method according to claim 39, further comprising:

storing a try-on garment identifier (TID) in a database associated with the try-on garment;

storing a base pattern identifier (BID) in the database associated with the base pattern; and linking the BID to the TID.

43. A method according to claim 42, further comprising:

making the TID visible on the try-on garment.

44. A method according to claim 43, wherein the base pattern is retrieved after the customer selects the try-on garment and the linked BID is retrieved from the database using the TID.

45. A method according to claim 38, wherein the specification data specifies the dimensions of the base pattern as adjusted by the mark lines.

46. A method according to claim 45, further comprising:

cutting fabric having the dimensions of the adjusted base pattern.

47. A method according to claim 46, further comprising:

sewing the cut fabric together with other fabric to produce the custom-made garment.

48. A method according to claim 45, further comprising storing the specification data and associating the stored data with the customer.

49. A method according to claim 38, further comprising:

adjusting the mark lines in accordance with parameters including one or more of salvage, shrinkage amount and easing amount.

50. A method according to claim 38, wherein the step of preparing the base pattern includes combining the features of two or more other base patterns.

51. A method according to claim 50, wherein the combining step includes aligning respective sets of horizontal and vertical reference marks and points of origin on the two or more base other patterns.

52. A method according to claim 38, wherein the step of preparing the base pattern includes:

receiving a favorite garment from the customer;

scanning the favorite garment to produce a digital image of the favorite garment;

identifying a seam in the scanned image;

separating the scanned image into a plurality of sets of digital data respectively corresponding to a plurality of pattern pieces using a computer system; and cutting material using the digital data to form the plurality of pattern pieces; and selecting the base pattern from the plurality of pattern pieces.

53. A method according to claim 52, wherein the step of separating the scanned image includes combining portions of certain pattern pieces with portions of certain other pattern pieces.

54. A method according to claim 38, further comprising:

storing a base pattern identifier (BID) in a database that is associated with the base pattern.

55. A method according to claim 38, further comprising:

using a try-on garment to identify and retrieve the base pattern; and using the try-on garment for locating and placing the mark lines on the base pattern.

56. A method according to claim 38, wherein the mark lines are placed on the base pattern during a custom-made garment order process involving the customer.

57. A method of producing a custom-made garment using facilities at first and second different sites that communicate using a teleconferencing system, comprising:

capturing and transmitting an image of a customer trying on a garment at the first site;

displaying at the second site the image of the customer;

identifying one or more base patterns associated with the garment at both the first and second sites;

marking certain of the base patterns in accordance with preferences of the customer; and modifying and connecting the marked base patterns to create a sample of the custom-made garment for the customer.

58. A method according to claim 57, further comprising:

scanning at least one of the base patterns at the first site to generate design data;

receiving the design data at the second site;

sending new data to the first site associated with the at least one base pattern; and printing marks on the at least one base pattern in accordance with the sent new data at the first site.

59. A method of producing a custom-made garment for a customer, comprising:

allowing the customer to select a try-on garment;

retrieving one or more base patterns comprising the try-on garment, each base pattern including a point of origin and reference lines;

marking the base patterns in accordance with the body contour and fit preferences of the customer;

modifying the base patterns in accordance with the markings;

connecting together the modified base patterns to form a sample of the custom-made garment;

recording images of the marked base patterns as digital data; and determining locations of the markings with respect to the point of origin of the base patterns.

60. A method according to claim 59, wherein the determined locations of the markings are in X-Y coordinates with respect to the point of origin.

* * * * *